United States Patent [19]

Horst et al.

[11] 4,398,711

[45] Aug. 16, 1983

[54] CURRENCY DISPENSER MONITOR

[75] Inventors: William R. Horst, Dayton; Robert H. Granzow, Miamisburg, both of Ohio

[73] Assignee: NCR Corporation, Dayton, Ohio

[21] Appl. No.: 290,895

[22] Filed: Aug. 7, 1981

Related U.S. Application Data

[63] Continuation of Ser. No. 108,874, Dec. 31, 1979, abandoned.

[51] Int. Cl.[3] ..... B65H 7/14; B65H 7/12

[52] U.S. Cl. ..... 271/263; 250/559; 250/231 R; 340/674; 356/381

[58] Field of Search ..... 271/263, 262; 209/603; 340/674, 675; 356/381; 250/231 R, 559, 571

[56] References Cited

U.S. PATENT DOCUMENTS

| | | | |
|---|---|---|---|
| 2,445,046 | 7/1948 | Tinkham | 73/115 |
| 3,187,186 | 6/1965 | Martin | 250/231 R |
| 3,283,163 | 11/1966 | Folmar | 271/263 X |
| 3,337,739 | 8/1967 | Sendro | 250/231 R |
| 3,578,315 | 5/1971 | Milford | 271/263 |
| 3,614,419 | 10/1971 | Daughton et al. | 250/223 R |
| 3,770,965 | 11/1973 | Edwards et al. | 250/231 R X |
| 3,826,487 | 7/1974 | Forster et al. | 271/263 |
| 3,873,843 | 3/1975 | Martin | 250/561 |
| 3,918,704 | 11/1975 | Sugiyama et al. | 271/263 X |
| 3,968,364 | 7/1976 | Miller | 250/231 R X |
| 4,066,969 | 1/1978 | Pearce et al. | 271/263 X |
| 4,095,781 | 6/1978 | Kistner et al. | 271/263 X |
| 4,151,410 | 4/1979 | McMillan et al. | 271/263 X |
| 4,154,437 | 5/1979 | Butcheck et al. | 271/263 X |
| 4,160,546 | 7/1979 | McMillan et al. | 271/263 |
| 4,249,076 | 2/1981 | Bergstrom et al. | 250/231 R X |
| 4,255,651 | 3/1981 | Phillips | 235/92 SB |
| 4,258,326 | 3/1981 | Johne | 328/5 |

OTHER PUBLICATIONS

Amundson et al., "Double Document Detector", IBM Tech. Discl. Bull., vol. 7, No. 8, Jan. 1965, p. 715.

Boothroyd, "Double Document Detect System", IBM Tech. Discl. Bull., vol. 19, No. 12, May 1977, pp. 4749–4750.

*Primary Examiner*—Bruce H. Stoner, Jr.

*Attorney, Agent, or Firm*—J. T. Cavender; Albert L. Sessler, Jr.; George Jameson

[57] ABSTRACT

An apparatus for monitoring the performance of a currency dispenser by detecting the displacement of a roller caused by the thickness of a record member. This displacement is measured by the movement of a graded density translucent member between the photodiode and sensor of a detector. Electronic circuitry associated with the detector indicates the presence of a record member between the rollers, and also the presence of multiple record members. The fabrication of the member allows the circuitry to detect only the displacement from the static position of the rollers, eliminating the necessity for adjustment due to wear, temperature, and other mechanical factors.

30 Claims, 9 Drawing Figures

CURRENCY DISPENSER MONITOR

This application is a continuation of application Ser. No. 108,874, filed Dec. 31, 1979, now abandoned.

CROSS-REFERENCE TO A RELATED APPLICATION

The present application is related to the copending U.S. patent application of William R. Horst, entitled "Method and Apparatus For Fabricating A Translucent Graded Density Membrane", Ser. No. 108,877, now U.S. Pat. No. 4,284,715, filed on the same day as the present application and assigned to the assignee of the present invention.

BACKGROUND OF THE INVENTION

This invention relates generally to an apparatus for detecting the passage of multiple documents in a dispensing system, and, in particular, to an apparatus which monitors a currency dispenser in order to sense the presence of multiple or double bills.

With the acceptance of automated financial terminals increasing rapidly, the role of the currency dispenser is growing more significant. Today terminals of this type, such as the device disclosed in U.S. Pat. No. 4,168,058, which is assigned to the assignee of the present invention, serve in an important capacity in the business and financial communities.

A major function of any currency dispenser is to remove bills from a stack and present them one at a time to a transport mechanism for delivery to the customer. This function may also be deemed the most critical, since problems in delivering the bills, such as failure to feed or the feeding of more than one bill at a time, generally begin at this stage. Because of the wide disparity in bill quality, ranging from new, crisp bills to limp, torn ones, as well as the occurrence of foreign matter between bills, preventing their separation, it is not possible to achieve perfect performance. Therefore, it is important to detect the problem situation and take corrective action immediately, such as the activation of a diverter gate, to capture the erroneously fed bills.

A number of different techniques have been used in the past for detecting the presence of multiple bills or record members in a dispensing system. These systems are mechanical, electrical, or optical devices, or a combination thereof, to sense the presence of multiple bills. Overall performance of a doubles detector, however, depends heavily on the means of determining if a document has been fed, and if so, whether it was a single document.

One method presently employed is based on measuring the optical transmission across the path of the document at a particular time in the machine cycle. A reduction in transmission signals the occurrence of a document in the transport. The amount of reduction will indicate if the document is of the proper thickness and, therefore, a single document. This method involves an optical system, consisting of a light source and sensor, which provides a calibrated output relative to document thickness. However, printed patterns on documents change the amount of light transmission; thus, the system must be calibrated for a particular location on the bill, and timed to read when that position is reached on the bill. Other potential problems which may arise in this type of system are: the light level must be held constant by auxiliary circuitry to provide a reference base; marks or blemishes on the bill can cause reading errors to occur; and the expected transmissivity of a bill changes with its life cycle.

Another method often used in doubles detectors employs a set of pinch rolls, one of which is mounted on a fixed shaft while the other is spring loaded against the first roll. If a bill enters the rolls, the spring mounted roll will move away from the fixed roll by an amount equal to the bill thickness. Measurement of this movement indicates presence of a single bill or multiple thicknesses. Since the thickness of a U.S. bill is approximately 0.010 centimeters, sensitive detectors, such as differential transformers or strain gauges, must be employed to measure the roll position. Also, mechanical linkages common to this method often create hysteresis and vibrational problems. Static changes in the roll position, caused by wear, elasticity, or accumulation of foreign matter, may result in a drift of the system from the operating range. In addition, since the electrical signal is a low level, auxiliary circuits must be used to provide compatible digital signal levels.

Other methods of detecting multiple documents employ short wavelength radiation with relatively complex detection circuitry, or the use of continuous vacuum for separating multiple sheets mechanically. However, all these methods of double document detection often suffer reliability problems in addition to adding significantly to the cost of the dispenser.

SUMMARY OF THE INVENTION

It is therefore an object of this invention to provide an efficient currency dispenser monitor with a simple, low cost design.

Another object of the invention is to provide a currency dispenser monitor which requires minimal adjustment and maintenance.

A further object of this invention is to provide a currency dispenser monitor through the combined use of mechanics, electronics, and optics.

A further object of this invention is to provide a currency dispenser monitor which allows the home position to shift slightly without affecting the calibration.

These and other objects may be accomplished in the present instance by use of a monitoring system containing means, responsive to the displacement of a translucent member, for controlling the output of a photodetector relative to the thickness of a record member which enters between the feed rollers of a currency dispenser. The associated circuitry only detects a displacement from the static home position of the feed rollers, thus allowing the home position to vary slightly without need for adjustment.

DESCRIPTION OF THE PREFERRED EMBODIMENT

Figure 1:
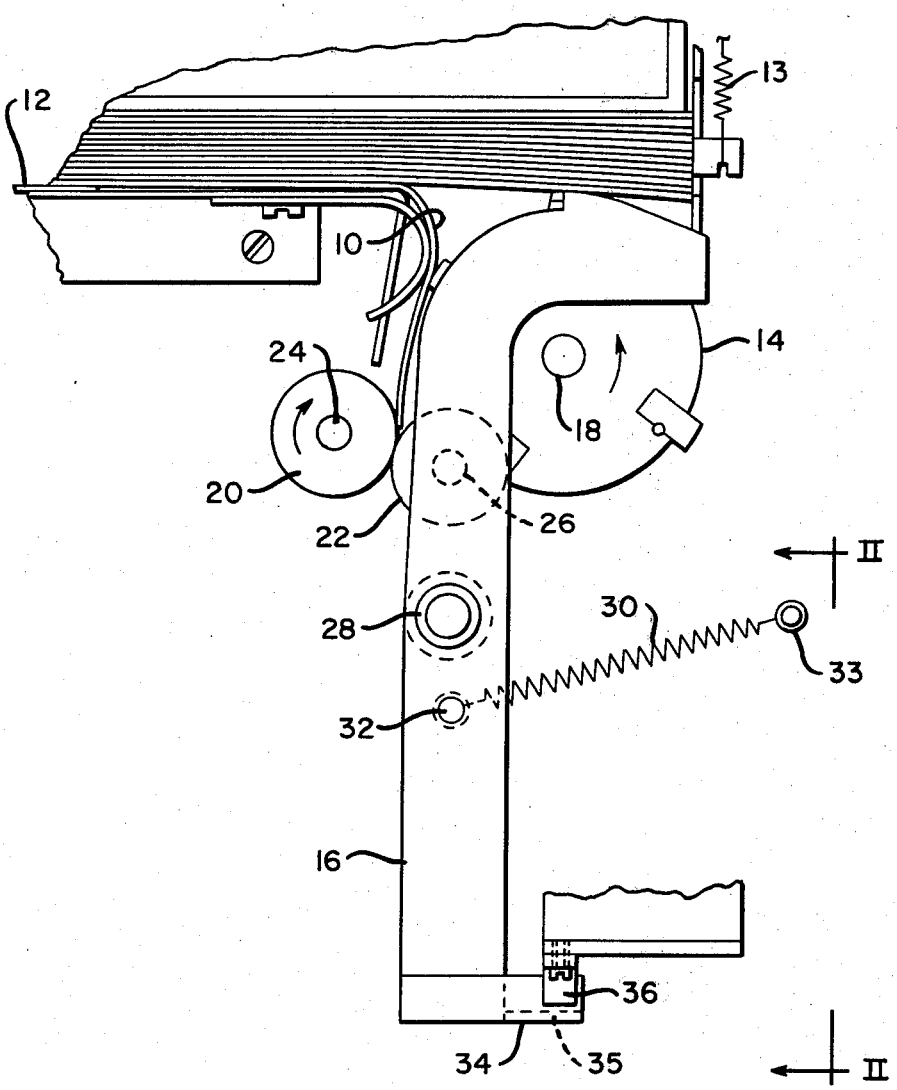
FIG. 1 is a diagrammatic view illustrating certain components of a currency dispenser.
Figure 2:
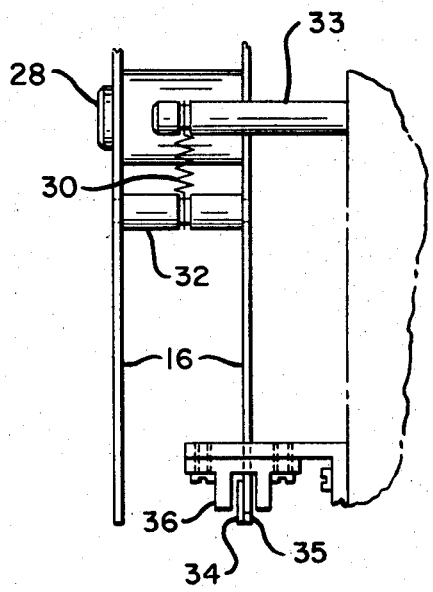
FIG. 2 shows a partial sectional view of the currency dispenser taken along the line 2—2 of FIG. 1.

Referring now to FIG. 1, there is shown a preferred embodiment of a currency dispenser. Currency or other record members 10 are urged against a table 12 by spring 13 for feeding. A pair of spaced-apart driving wheels 14, each located between two adjacent arms of an assembly 16, are fixed to a shaft 18 to be driven thereby. During the feeding operation, currency 10 is urged by driving wheels 14 between a pair of rollers 20 and 22. In the preferred embodiment, both rollers are composed of an aluminum core with a polyurethane covering. Feed roller 20 is fixed at the end of a motor shaft 24, which rotates at a surface speed of 100 inches per second. Idler roller 22 is rotatably mounted on a short shaft 26, which freely rotates in the arms of assembly 16. Arm assembly 16 is pivotally mounted on a shaft 28 and tensioned by a spring 30, which spring is attached to arm assembly 16 at connecting pin 32. The opposite end of spring 30 is attached to a short shaft 33. Spring 30 applies a force on arm assembly 16 such that roller 22 is urged into cooperating engagement with roller 20. For a more detailed description of the above-described structure, reference may be had to the previously-described U.S. Pat. No. 4,168,058.

As currency 10 is fed between rollers 20 and 22, roller 22 is forced away from roller 20 a distance equal to the thickness of the currency 10, causing arm assembly 16 to pivot about shaft 28, and displacing the bottom of arm assembly 16 in the direction toward roller 20. In the present embodiment, the distance between shaft 28 and the bottom of arm assembly 16 is three times greater than the distance between shaft 28 and shaft 26; therefore, the bottom of arm assembly 16 is displaced toward roller 20 three times further than roller 22 is moved away from roller 20 when currency 10 is fed between rollers 20 and 22. Consequently, when using U.S. currency, which has a normal average thickness of 0.010 centimeters, the bottom end of arm assembly 16 will travel approximately 0.030 centimeters when a single bill passes between rollers 20 and 22.

A membrane 34 of processed photographic film is bonded along a protrusion 35 on the end of arm assembly 16. Membrane 34 is fabricated in a manner which is the subject of the previously cited co-pending application of Horst, which is assigned to the assignee of the present application and fully incorporated into this application by reference, and which manner will be subsequently described in greater detail. Membrane 34 is attached to arm assembly 16 such that it moves between the light source and sensor of a detector module 36 as the bottom end of arm assembly 16 is displaced. Since membrane 34 is processed in such a manner as to exhibit a relatively rapid change in optical density in a direction parallel to its length, the described motion of arm assembly 16 will change the amount of light activating the sensor of module 36. Thus, the electrical output of detector 36 is relative to the position of arm assembly 16.

In the present embodiment, the currency dispenser monitor is used to detect the presence of a single bill in addition to sensing the presence of multiple bills. However, due to several different factors, the home position of rollers 20 and 22 may change. Causes for the position drift may be variations in the resilience of the polyurethane surface covering of the rollers, wearing of the surfaces, ink deposits from the bills, wear in the bearings, or changes in ambient temperatures which cause expansion or contraction of the machine base and components. Experimental analysis of this home position drift indicates that it may shift plus or minus 0.075 centimeters from its initial position. Therefore, assuming a 0.075 centimeter displacement being necessary for detecting multiple bills, a linear measurement range of 0.225 centimeters is preferred for satisfactory operation of the doubles detector.

In the preferred embodiment, for cost considerations it is desirable to use a low-cost and commercially-available component in the circuit of detector 36 which is pre-aligned, and has a sufficiently high electrical output to provide direct drive of the associated electronic circuitry. A satisfactory component is General Electric type H13B1 photon-coupled interruptor module, which is composed of a gallium arsenide solid-state lamp illuminating a silicon photo-darlington sensor across an air gap of 0.318 centimeters. This component and the membrane provide the entire optical system for the present currency dispenser monitor.

These detector units, however, have an active optical area of only 0.050 to 0.075 centimeters. Therefore, if the membrane contained a sharp opaque/transparent transition line, the desired range of 0.225 centimeters could not be reached. To expand the operating range, an incremental graded density membrane can be used.

The fabrication of membrane 34 involves exposing a photographic film for 105 seconds to a tungsten lamp which is blocked by a piece of black photographic paper except for a 1.27 centimeter wide aperture. As light passes through the aperture in the paper, it is diffused by two ground glass plates in such a manner as to cause the light striking the film to decrease as the distance from the edge of the image of the aperture increases.

The film used in this progress produces a negative transparency, and also eliminates the need for external processing. Thus, the area on the film corresponding to the 1.27 centimeter wide aperture becomes dark with exposure. The optical density of the film changes in a relatively linear manner from very dark to a much greater transparency corresponding to the image of the black paper, since the diffused light becomes less with increasing distance.

The linear density gradient filmstrip enables the detector to operate over a greater travel distance. Any movement of the film will cause a change in the intensity of light which the sensor of the detector receives; therefore, the length of the filmstrip determines the operating range of the detector.

Figure 3:
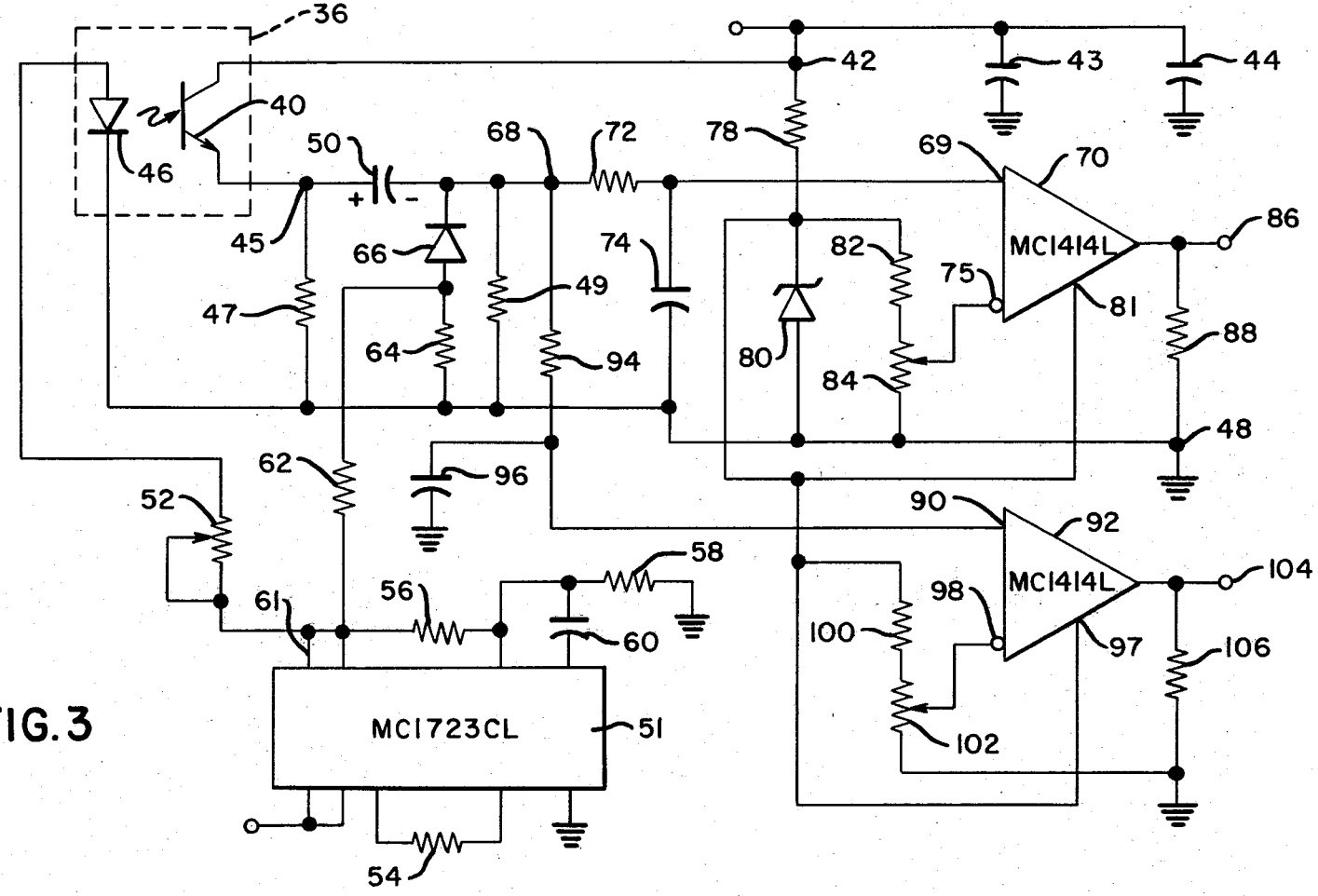
FIG. 3 is a schematic diagram of the monitoring circuitry of the currency dispenser.

FIG. 3 shows the electronic circuitry which, taken together with detector 36, comprises the monitor control. A phototransistor 40 contained within detector 36 acts as a variable resistor between the supply voltage 42, which is filtered by capacitors 43 and 44, and line 45. The resistance of phototransistor 40 is controlled illumination emitted by a photodiode 46 also contained within detector 36. As the illumination from photodiode 46 increases when membrane 34 is moved in one direction within the air gap between the components of detector 36, the circuit voltage becomes more positive across a resistor 47 with respect to ground 48. The voltage on line 45 is also applied to a filtering combination of resistor 49 and capacitor 50. The coupling capacitor 50 blocks the DC component of the voltage at 45, which voltage is proportional to the quiescent position of membrane 34, arm assembly 16, and roller 22, allowing the circuit to respond only to changes in the position of membrane 34 between the components of detector 36. Thus, the circuit of FIG. 3 is independent of the static position of rollers 20 and 22, and reacts only to a physical movement of roller 22, which also causes movement of arm assembly 16 and filmstrip 34; mechanical drift of the static roller position will not affect operation of the circuit.

Current to operate photodiode 46 is supplied from a voltage regulator 51 via a potentiometer 52. Regulator 51 may be an integrated circuit chip, such as Motorola Type MC1723CL or its equivalent, and serves to insure a sufficient calibrated current supply to photodiode 46 for proper operation. Regulator 51 and its associated components (resistors 54, 56, 58 and capacitor 60) may be eliminated if the power supply used to drive the circuit is sufficiently stable.

The output 61 of regulator 51, which is approximately 8 volts, is applied to another portion of the detection circuitry via resistors 62 and 64 and a diode 66. Diode 66 tends to hold the voltage across resistor 64 on the cathode of capacitor 50, which provides a fast recovery from the charge condition on capacitor 50.

The voltage at 68 is applied to the non-inverting input 69 of a differential comparator 70 via an integrating network of resistor 72 and capacitor 74. Comparator 70, which may be a Motorola type MC1414L or its equivalent, detects the presence of more than one bill between rollers 20 and 22. The reference voltage for the inverting input 75 of comparator 70 is generated when the supply voltage at 42 is transmitted across a series combination of a resistor 78 and a zener diode 80. The voltage present across zener diode 80, which is approximately 3.9 VDC, is transmitted to the strobe input 81 of comparator 70, and also to input 75 via a resistor 82 and a potentiometer 84. Potentiometer 84 makes it possible to adjust the reference voltage for input 75 to a desired level for precise detection of a single bill thickness. Thus, when the voltage at input 69 exceeds the reference voltage at 75 by a few millivolts, indicating that a doubles condition has occurred, comparator 70 outputs a fast rising TTL compatible signal at terminal 86 across a load resistor 88.

Detection of the presence of a single bill is accomplished in a similar manner. The voltage at 68 is applied to the non-inverting input 90 of a differential comparator 92 via an integrating network of a resistor 94 and a capacitor 96. Comparator 92 may be a Motorola type MC1414L or its equivalent. The reference voltage across zener diode 80 is applied to the strobe input 97 of comparator 92, and also to the inverting input 98 via a resistor 100 and a potentiometer 102. Potentiometer 102 adjusts the reference voltage for input 98 to a desired level such that the signal received at input 90 exceeding this reference voltage is indicative of one or more bills passing between rollers 20 and 22. Thus, when the voltage at input 90 exceeds the reference voltage at 98 by a few millivolts, comparator 92 outputs a signal to terminal 104 across a load resistor 106, indicating the presence of at least a single bill between rollers 20 and 22.

Figure 4:
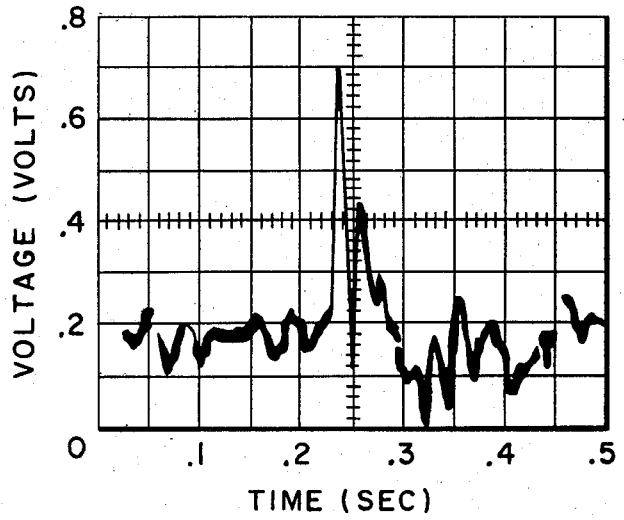
FIG. 4 shows the unfiltered waveform of a single bill passing through the currency dispenser with its leading edge folded over.
Figure 5:
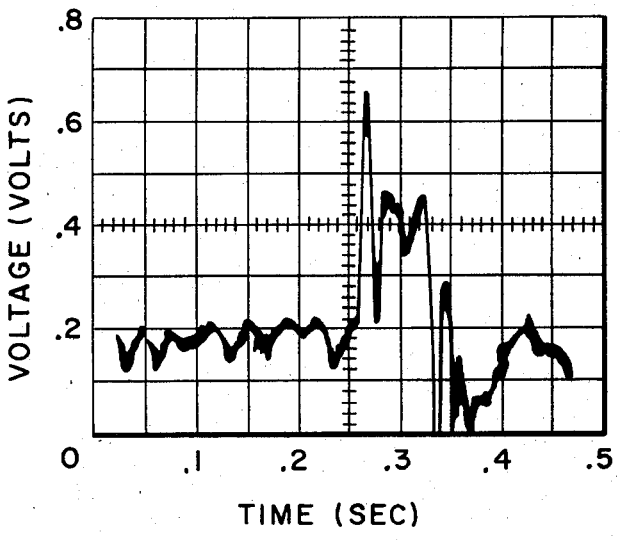
FIG. 5 shows the unfiltered waveform of a double bill passing through the currency dispenser.

The necessity for the integrating network of resistor 72/capacitor 74 is illustrated by the waveforms shown in FIGS. 4 and 5. FIG. 4 shows the waveform of the voltage at 68 when a single bill with the leading edge folded back approximately one-half inch is inserted between rollers 20 and 22. The initial bounce caused as the bill enters rollers 20 and 22 is of sufficient amplitude to trigger comparator 70, which would output a false double detection signal. As a comparison, FIG. 5 shows the waveform of the voltage at 68 when a double bill travels between rollers 20 and 22. The signal in FIG. 5 shows the initial bounce caused by the double bill entering rollers 20 and 22, but the signal also remains at a sufficient level for triggering comparator 70 for a longer time period, due to the extra thickness along the entire length of the bill. When the integrating network is used, the initial bounce is softened, allowing comparator 70 to detect only true double bills.

Figure 6:
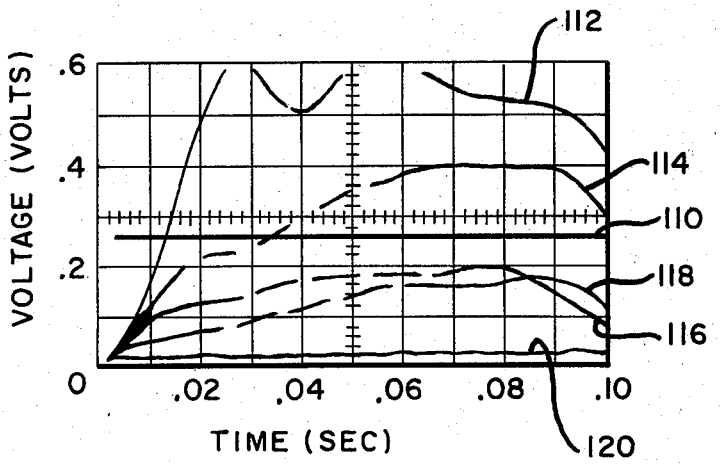
FIG. 6 shows the waveforms of several bills as inputs to the doubles detection comparator.

FIG. 6 shows waveforms of the signals generated by various bills at input 69 to comparator 70, which signals have been smoothed by the integrating network of resistor 72/capacitor 74. Line 110 represents the double detection threshold; any signal rising above this will trigger comparator 70.

Signal 112 represents a double bill with its leading edge folded back approximately one-half inch; it is readily detected by comparator 70. Signal 114 shows a double bill; it is also detected by comparator 70. Signal 116 represents a single bill with its leading edge folded back approximately one-half inch; the integrating network has filtered the signal so that it will not cause comparator 70 to falsely trigger. Signal 118 shows the waveform for an unfolded single bill; it also is not great enough to activate comparator 70. Finally, the idle noise of the circuitry is represented by signal 120.

Figure 7:
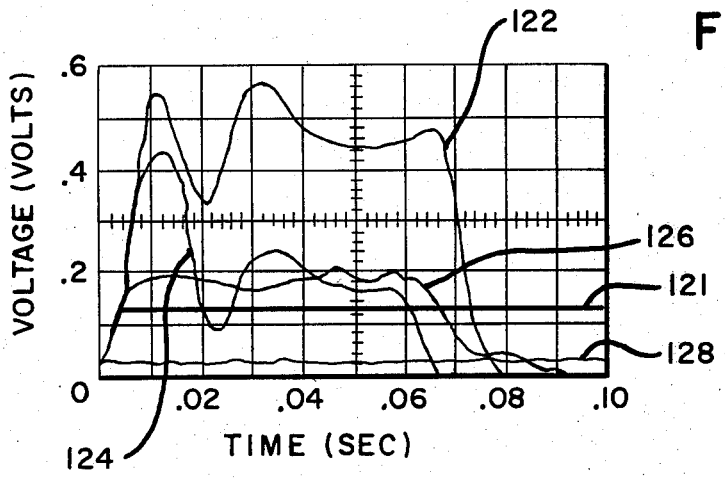
FIG. 7 shows the waveforms of several bills as inputs to the presence detection comparator.

A lesser degree of integration is provided by the integrating network of resistor 94/capacitor 96, which balances the signal to eliminate noise pulses from mechanical shock, and yet preserve the pulse width as a means of detecting the time of bill entry and removal from rollers 20 and 22. FIG. 7 shows waveforms of the signals generated by various bills at input 90 to comparator 92, which signals have been smoothed by the integrating network of resistor 94/capacitor 96. Line 121 indicates the present detect threshold; any signal rising above this will trigger comparator 92.

Signal 122 represents a double bill, signal 124 represents a single bill with the leading edge folded back one-half inch, and signal 126 represents an unfolded single bill. As shown in FIG. 7, these three signals are sufficiently high enough to surpass the present detection threshold, triggering comparator 92. Signal 128 represents idle noise picked up by the circuitry; it is not strong enough to activate comparator 92.

Figure 8:
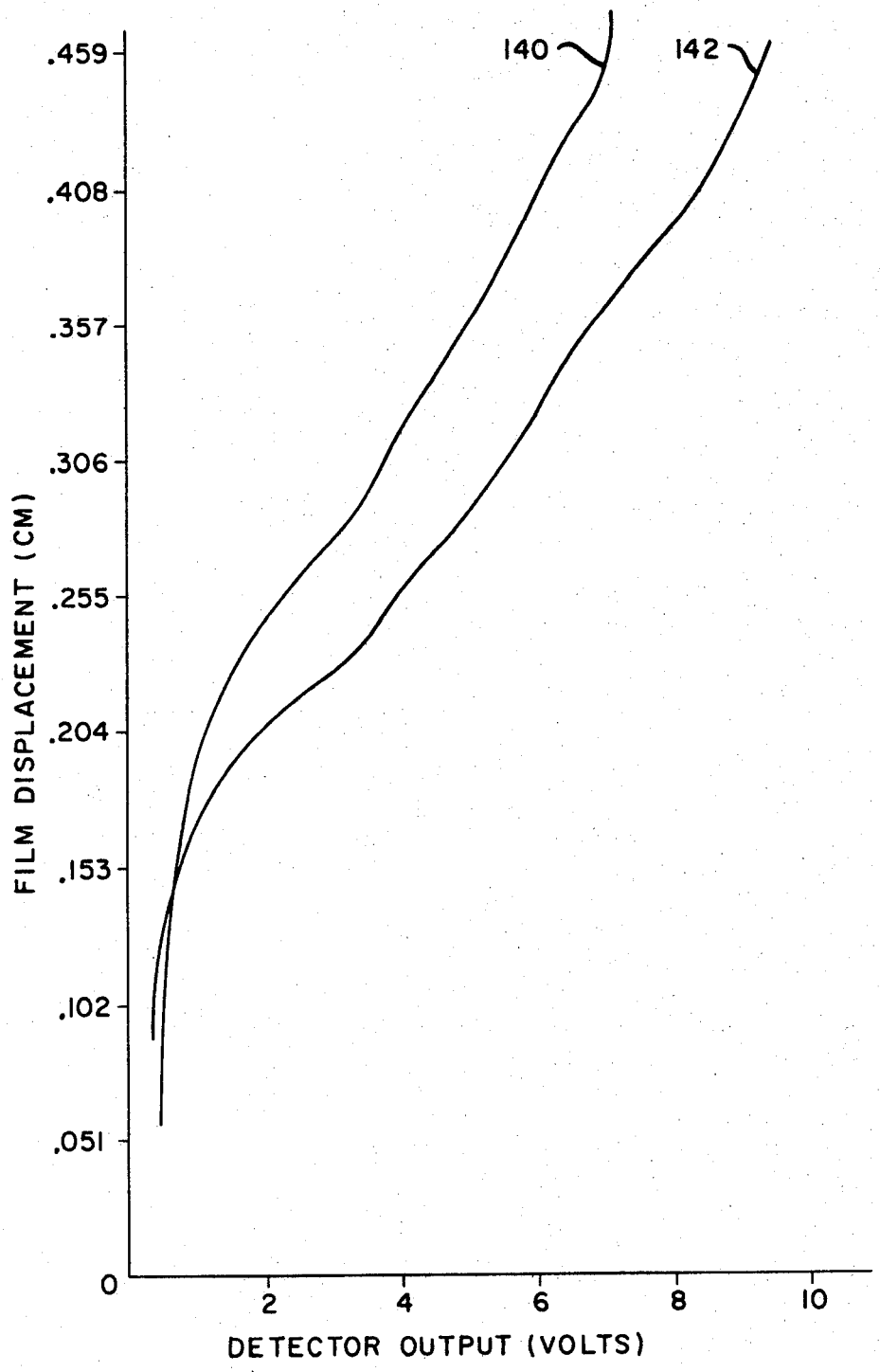
FIG. 8 is a graph of the output voltages of several detectors versus displacement of the film strip.

Due to the fact that commercially available pre-aligned detector modules do not necessarily exhibit precisely identical characteristics, the operating curves of different detectors may vary. FIG. 8 is a graph showing curves 140 and 142 representing the output voltages of two detectors with respect to the displacement of the graded density film strip which is used in the currency dispensor monitor. The graphs show that as the distance from the dark-to-light transition area of the film strip increases the output voltages of the detectors increase in a linear fashion.

Figure 9:
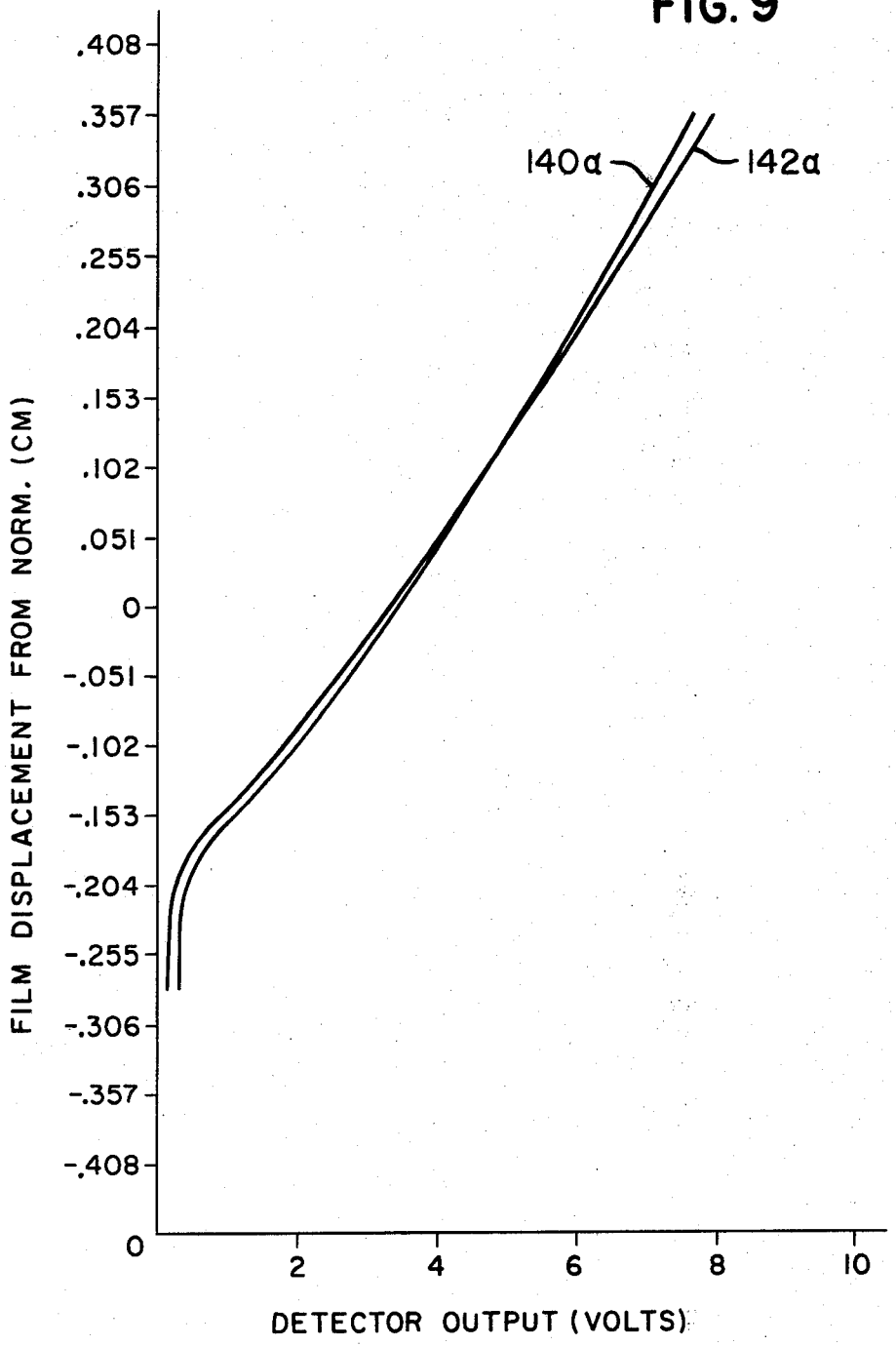
FIG. 9 is a graph of the normalized output voltage of several detectors versus displacement of the film strip from the energized center position.

To achieve uniform results from the monitor using commercially available detectors, it is necessary to normalize the output of the detector at a known point in the linear region of its operating curve. Referring to FIG. 8, it can be seen that if the film strip is "centered" at a displacement of 0.317 centimeters, a linear operating range of 0.254 centimeters can be easily obtained from curves 140 and 142. Using the displacement of 0.317 centimeters, each detector can be normalized in the circuitry of FIG. 3 by adjusting potentiometer 52 until the current through photodiode 46 of the detector module 36 reaches a prescribed level while the output voltage of the phototransistor 40 is held at a fixed level. The current level was analytically and experimentally determined to be 590 microamps, using a 4 volt output across phototransistor 40. The normalized operating curves 140*a* and 142*a* of the detectors used in FIG. 8 are shown in FIG. 9. The graph of FIG. 9 plots the normalized detector output against the "centered" or normalized position of the film strip. Curves 140*a* and 142*a* show that, over a 0.254 centimeter range (±0.127 centimeters from the normalized position), the output voltages of two commercial detectors can be normalized to obtain a uniform response.

Typical values of the components of the circuit of FIG. 3 may be as follows:

| | Value |
|---|---|
| Resistors | |
| 82, 88, 100, 106 | 1K ohms |
| 72, 47, 94, 58 | 6.8K ohms |
| 78 | 390 ohms |
| 49 | 33K ohms |
| 64 | 750 ohms |
| 62 | 7.5K ohms |
| 54 | 680 ohms |
| 56 | 820 ohms |
| Capacitors | |
| 43 | .01 microfarads |
| 44, 74 | 4.7 microfarads |
| 50 | 15 microfarads |
| 96 | 1 microfarad |
| 50 | 100 picofarads |
| Potentiometers | |
| 52, 84, 102 | 500 ohms |
| Diodes | |
| 80 | 1N748A |
| 66 | 1N906 |

While the invention has been shown and described in terms of a preferred embodiment thereof, it will be understood that the invention is not limited to this particular embodiment and that many changes and modifications may be made without departing from the spirit and scope of the invention as defined in the appended claims.

We claim:

1. An apparatus for detecting the passing of record members in a transport system, said apparatus comprising:

means for gauging the thickness of record members as said members move along a predetermined path;

means for detecting a displacement of said gauging means;

means, coupled to said gauging means, for modulating said detecting means relative to the magnitude of displacement from the static position of said gauging means in a manner which allows for variation of said static position; and circuit means responsive to said detecting means for generating a plurality of signals which are utilized to indicate certain conditions when said record members pass through said gauging means, said circuit means including means for inhibiting a voltage representative of the static position of said gauging means and producing a voltage representative of the differential movement of said gauging means.

2. The apparatus of claim 1, wherein said circuit means generates said signals in response to displacement of said gauging means from said static position.

3. The apparatus of claim 2, wherein said circuit means generates a first signal corresponding to a condition wherein multiple record members simultaneously pass through said gauging means.

4. The apparatus of claim 3, wherein said circuit means generates a second signal corresponding to a condition wherein at least a single record member passes through said gauging means.

5. The apparatus of claim 1, wherein said modulating means comprises a translucent member.

6. The apparatus of claim 5, wherein said member contains translucency of graded density.

7. The apparatus of claim 6, wherein said density of translucency is graded linearly.

8. The apparatus of claim 7, wherein the maximum allowable variation of said static position is approximately ±0.075 centimeters.

9. The apparatus of claim 1, wherein said gauging means comprises a pair of cooperating rollers.

10. The apparatus of claim 9, wherein said pair of cooperating rollers comprises a first fixed roller and a second roller which is mobile with respect to said first roller.

11. The apparatus of claim 10, wherein said record members feed between said first and second rollers.

12. The apparatus of claim 11, wherein said modulating means is mechanically coupled to said second roller and is responsive to a displacement of said second roller.

13. The apparatus of claim 1, wherein said detecting means comprises illuminating means and sensing means.

14. The apparatus of claim 13, wherein said illuminating means comprises a photodiode.

15. The apparatus of claim 13, wherein said sensing means comprises a phototransistor.

16. A currency dispenser monitoring device for detecting the passing of bills in a transport system, said device comprising:

means for gauging the thickness of bills as said bills move along a predetermined path;

means for detecting a displacement of said gauging means;

means, coupled to said gauging means, for modulating said detecting means relative to the magnitude of displacement from the static position of said gauging means in a manner which allows for variation of said static position; and circuit means responsive to said detecting means for generating a plurality of digital signals corresponding to certain conditions when said bills pass through said gauging means, said circuit means including means for inhibiting a voltage representative of the static position of said gauging means and producing a voltage representative of the differential movement of said gauging means.

17. The device of claim 16, wherein said circuit means generates said signals in response to displacement of said gauging means from said static position.

18. The device of claim 17, wherein said circuit means generates a first digital signal corresponding to a condition wherein multiple bills simultaneously pass through said gauging means.

19. The device of claim 18, wherein said circuit means generates a second digital signal corresponding to a condition wherein at least a single bill passes through said gauging means.

20. The device of claim 16, wherein said modulating means comprises a translucent section of photographic film.

21. The device of claim 20, wherein said section of film contains translucency of graded density.

22. The device of claim 21, wherein said density of translucency is graded linearly.

23. The device of claim 22, wherein the maximum allowable variation of said static position is approximately ±0.075 centimeters.

24. The device of claim 16, wherein said gauging means comprises a pair of cooperating rollers.

25. The device of claim 24, wherein said pair of cooperating rollers comprises a first fixed roller and a second roller which is mobile with respect to said first roller.

26. The device of claim 25, wherein said bill feeds between said first and second rollers.

27. The device of claim 26, wherein said modulating means is mechanically coupled to said second roller and is responsive to a displacement of said second roller.

28. The device of claim 16, wherein said detecting means comprises illuminating means and sensing means.

29. The device of claim 28, wherein said illuminating means comprises a photodiode.

30. The device of claim 28 wherein said sensing means comprises a phototransistor.

* * * * *